US008339328B2

(12) United States Patent
Narasimhan et al.

(10) Patent No.: US 8,339,328 B2
(45) Date of Patent: Dec. 25, 2012

(54) RECONFIGURABLE MULTI-BAND ANTENNA AND METHOD FOR OPERATION OF A RECONFIGURABLE MULTI-BAND ANTENNA

(76) Inventors: Vijay Kris Narasimhan, Ottawa (CA); Colan Graeme Ryan, Ottawa (CA)

( * ) Notice: Subject to any disclaimer, the term of this patent is extended or adjusted under 35 U.S.C. 154(b) by 273 days.

(21) Appl. No.: 12/444,992

(22) PCT Filed: Oct. 10, 2007

(86) PCT No.: PCT/CA2007/001794
§ 371 (c)(1),
(2), (4) Date: Apr. 9, 2009

(87) PCT Pub. No.: WO2008/046193
PCT Pub. Date: Apr. 24, 2008

(65) Prior Publication Data

US 2010/0033397 A1 Feb. 11, 2010

Related U.S. Application Data

(60) Provisional application No. 60/850,138, filed on Oct. 10, 2006.

(51) Int. Cl.

| | |
|---|---|
| ***H01Q 1/38*** | (2006.01) |
| ***H01Q 5/00*** | (2006.01) |
| ***H01Q 9/04*** | (2006.01) |
| ***H01Q 1/24*** | (2006.01) |
| ***H01Q 1/48*** | (2006.01) |
| ***H01Q 1/50*** | (2006.01) |
| ***H01Q 3/24*** | (2006.01) |

(52) U.S. Cl. ..... 343/876; 343/700 MS; 343/702; 343/845; 343/860

(58) Field of Classification Search ..... 343/702, 343/700 MS, 860, 876, 845
See application file for complete search history.

(56) References Cited

U.S. PATENT DOCUMENTS 6,204,826 B1 * 3/2001 Rutkowski et al. ..... 343/895
6,337,663 B1 * 1/2002 Chi-Ming ..... 343/702
(Continued)

FOREIGN PATENT DOCUMENTS

WO WO 01/63699 8/2001

OTHER PUBLICATIONS

PCT International Search Report for PCT/CA2007/001794 completed by the CA Searching Authority on Jan. 2, 2008.

(Continued)

*Primary Examiner* — Douglas W Owens
*Assistant Examiner* — Jennifer F Hu
(74) *Attorney, Agent, or Firm* — Barnes & Thornburg LLP

(57) ABSTRACT

A multi-band antenna is provided. The antenna includes a radiating element resonant for at least two resonant frequencies, and at least two matching elements that are electrically connectable to the radiating element to substantially match an input impedance of the antenna to a reference impedance for each one of the at least two resonant frequencies. A method for transmitting and receiving on one or more frequency bands is also provided that includes selecting at least one resonant frequency, selectively electrically connecting a matching element corresponding to the at least one selected resonant frequency to a radiating element resonant at the one or more frequency bands, and receiving or transmitting a wireless signal at the at least one selected resonant frequency with the radiating element.

17 Claims, 9 Drawing Sheets

U.S. PATENT DOCUMENTS

| | | | | |
|---|---|---|---|---|
| 6,611,691 | B1 | 8/2003 | Zhou et al. | |
| 6,693,594 | B2 * | 2/2004 | Pankinaho et al. | 343/700 MS |
| 6,819,287 | B2 * | 11/2004 | Sullivan et al. | 343/700 MS |
| 6,903,686 | B2 * | 6/2005 | Vance et al. | 343/700 MS |
| 7,019,696 | B2 | 3/2006 | Jenwatanavet | |
| 7,245,260 | B2 * | 7/2007 | Chang | 343/700 MS |
| 7,319,432 | B2 * | 1/2008 | Andersson | 343/702 |
| 7,439,911 | B2 * | 10/2008 | Wang | 343/700 MS |
| 7,642,969 | B2 * | 1/2010 | Nam | 343/702 |
| 2001/0050635 | A1 * | 12/2001 | Weinberger | 343/700 MS |
| 2002/0180650 | A1 * | 12/2002 | Pankinaho et al. | 343/702 |
| 2004/0227678 | A1 | 11/2004 | Sievenpiper | |
| 2005/0242998 | A1 * | 11/2005 | Fabrega-Sanchez | 343/700 MS |
| 2005/0280586 | A1 * | 12/2005 | Bit-Babik et al. | 343/702 |
| 2006/0082506 | A1 * | 4/2006 | Fang | 343/700 MS |
| 2007/0069956 | A1 * | 3/2007 | Ozkar | 343/700 MS |
| 2007/0103367 | A1 * | 5/2007 | Wang | 343/700 MS |
| 2007/0236398 | A1 * | 10/2007 | Nam | 343/702 |
| 2010/0117909 | A1 * | 5/2010 | DeJean | 343/702 |
| 2010/0253581 | A1 * | 10/2010 | Tsou | 343/702 |

OTHER PUBLICATIONS

H.Y. David Yang, "Printed Straight F Antennas for WLAN and Bluetooth"; IEEE Antennas and Propagation Society International Symposium, 2003, vol. 2, pp. 918-921.

* cited by examiner

RECONFIGURABLE MULTI-BAND ANTENNA AND METHOD FOR OPERATION OF A RECONFIGURABLE MULTI-BAND ANTENNA

CROSS REFERENCE TO RELATED APPLICATIONS

This application is a U.S. national counterpart application of international application serial No. PCT/CA2007/001794 filed Oct. 10, 2007, which claims priority to U.S. Provisional Patent Application No. 60/850,138 filed on Oct. 10, 2006. The entire disclosures of PCT/CA2007/001794 and U.S. Ser. No. 60/850,138 are hereby incorporated by reference.

FIELD OF THE INVENTION

The present invention relates to compact, multi-band antennas suitable for mounting internally in wireless radio devices.

BACKGROUND

Many wireless devices currently operate on multiple frequency bands. These bands may be widely spaced in the frequency spectrum. For example, existing CDMA (Code Division Multiple Access) cell phones can operate in the 800 MHz and 1900 MHz bands. Operation on other bands is also foreseeable as mobile networks adopt new wireless technologies, such as WiFi and WiMax technologies for data transmission, which communicate at other frequencies, such as 2.4 GHz, 2.5 GHz, 3.5 GHz, or 5.8 GHz.

In most cases, it is desirable for antennas to have a high ratio of radiated power to incident power at all frequencies of operation, thus reducing wasted energy during both transmit and receive operations and minimizing potentially damaging power reflected back through the feeding terminal of the antenna. This ratio consists of two components: the antenna efficiency, $e_{radiation}$, and a factor, X, relating power entering the antenna, $P_{entering}$, and power incident on the antenna, $P_{incident}$:

$$\frac{P_{radiated}}{P_{incident}} = e_{radiation} \cdot X$$

where $$e_{radiation} = \frac{P_{radiated}}{P_{entering}} \text{ and } X = \frac{P_{entering}}{P_{incident}} = [1 - |\Gamma_{terminal}|^2].$$

$\Gamma_{terminal}$ is the reflection coefficient between the feeding terminal and the antenna. A smaller value of $\Gamma_{terminal}$ represents less power reflected and more power that has entered the antenna. Since the radiation efficiency depends on the antenna layout and materials, it is generally fixed for a given design. Therefore, to increase the ratio of radiated power to incident power, X may be reduced by minimizing the reflection coefficient by matching the circuit.

The system is perfectly matched when $Z_{in}$ (the impedance of the antenna) is equal to $Z_0$ (the impedance of the feed network), thus making the reflection coefficient zero as shown by the following relation:

$$\Gamma_{terminal} = \frac{Z_{in} - Z_0}{Z_{in} + Z_0}.$$

When $\Gamma_{terminal}=0$, all power incident on the antenna from the feed terminal is accepted by the antenna. Since standard feed networks typically present only real impedance, the antenna should ideally present a zero reactance at the frequency of operation and a resistance equal to that of the feed network to be perfectly matched. To meet this goal, therefore, antennas are generally sized to resonate (i.e., present zero reactance) near or at the frequency band or frequency bands of operation.

A straightforward way of operating in multiple bands is to use more than one antenna, each resonant at a different frequency. For example, U.S. Pat. No. 7,019,696 to Jatupum Jenwatanavet, "Tri-band Antenna," which is hereby incorporated by reference in its entirety, describes a system in which three antennas are combined to operate at three different frequency bands, and each antenna is sized for one particular frequency.

The ongoing miniaturization of wireless devices indicates that the antennas used in portable cell phones, PDAs, network cards, laptops and the like, will have to be of a relatively small size to be capable of being integrated into the devices.

The multi-antenna arrangement described in U.S. Pat. No. 7,019,696 and others like it that use multiple antennas to achieve multi-band operation replicate elements common to each antenna, and these replicated elements take up space, which may be unacceptable in some applications.

Several attempts have been made to design antenna structures that resonate at multiple frequencies. For example, U.S. Pat. No. 6,611,691, to Guangping Zhou, Michael J. Kuksuk, Robert Kenoun, and Zafarul Azam, "Antenna adapted to operate in a plurality of frequency bands," which is hereby incorporated by reference in its entirety, discloses a whip antenna that can be extended to two lengths to achieve two different resonant frequencies. However, such an antenna is too large to be effectively integrated inside many wireless devices, and it would also be cumbersome to operate, since some mechanical system would be needed to extend the antenna to change it from one mode of operation to the other. The antenna would typically extend outwardly from the device and could easily break off.

To meet the sizing requirements for portable wireless devices, many varieties of conventional compact antennas have been developed, including bent antennas. Bent antennas include bends along the length of the antenna, thereby increasing the electrical length of the antenna within a given area.

A popular design for compact antennas is the Inverted-F Antenna (IFA), which is described in H. Y. David Yang, "Printed Straight F Antennas for WLAN and Bluetooth"; IEEE Antennas and Propagation Society International Symposium, 2003, 22-27 Jun. 2003, Volume: 2, page(s): 918-921, which is hereby incorporated by reference in its entirety.

An example of a conventional IFA 20 is shown in FIG. 1. This antenna 20 is essentially a bent monopole, except that the grounding point 28 and feed point 22 are separated. A signal is fed into the feed point 22 of the antenna 20 through a connector (not shown). The antenna 20 has a first line length 25 that splits into a first branch 24 and a second branch 26. The end of the second branch 26 is grounded and acts as the grounding point 28 of the antenna 20. The second branch 26 includes a bend that allows the electrical length of the second branch to be increased without significantly increasing the area occupied by the antenna 20.

The impedance presented by a monopole antenna at its feed point 22 depends on the location of the feed point 22 relative to the ground point 28, as illustrated in FIG. 2. If the feed point 22 is moved closer to the ground point 28, effectively shortening the second branch 26 and increasing the length of the first branch 24, the impedance of the antenna 20 to a signal source 30 at the feed point 22 decreases. Alternatively, if the feed point 22 is moved further from the ground point 28, effectively increasing the length of the second branch 26 and shortening the first branch 24, the impedance of the antenna 20 to the signal source 30 at the feed point 22 increases. Thus, by appropriately positioning the feed point 22 relative to the ground point 28, a higher or lower impedance will be seen by the signal source 30 and proper matching can be achieved to increase the ratio of radiated power to incident power. Note that this property also applies in general to other types of antennas.

Although most IFAs are used at a single frequency band, some multi-band designs have been disclosed. U.S. Pat. No. 6,819,287 to Jonathan Lee Sullivan and Douglas Kenneth Rosener, "Planar inverted-F antenna including a matching network having transmission line stubs and capacitor/inductor tank circuits," which is hereby incorporated by reference in its entirety, describes an IFA capable of selective dual-band operation; these two bands, however, are two natural resonances of the full antenna length, and thus this arrangement cannot be applied to systems where the desired frequency bands are not as such.

Discontinuities in an antenna, including changes in impedance, materials, and geometry, also create additional resonances. Beyond simply reducing the antenna footprint, bends are particularly useful as discontinuities because energy is reflected at each discontinuity in the line caused by each bend, creating a null in the standing wave pattern and creating an additional resonance. The antenna would resonate at the total electrical length of the antenna and also at the electrical lengths measured from the source to each discontinuity. Therefore, multiple resonances at frequencies that are not related to the natural resonance of the total length of the antenna can be obtained using multiple bends.

U.S. Pat. No. 6,903,686 (hereinafter referred to as the '686 patent), to Scott LaDell Vance, Gerard Hayes, Huan-Sheng Hwang, and Robert A. Sadler, "Multi-branch planar antennas having multiple resonant frequency bands and wireless terminals incorporating the same," which is hereby incorporated by reference in its entirety, uses the multi-resonant property of an Inverted-F Antenna; the design is shown in FIG. 3.

In the design shown in FIG. 3, the antenna 120A includes a straight portion 121$c_1$ and a curved portion 121$c_2$. The antenna 120A is driven at a feed point 161$s$ by a source and is grounded at a ground point 161$g$.

The '686 patent mentions that the antenna 120A can resonate at multiple frequencies (800 MHz, 900 MHz, 1800 MHz and/or 1900 MHz). Use of the antenna's natural multiple resonances will result in zero input reactance at these frequencies. However, the resistance, as specified by the location of the feed point 161$s$ relative to the ground 161$g$, will be optimized for the primary design frequency only, and thus, the efficiency is likely to be lower at other frequencies of operation. For instance, FIG. 9 of the '686 patent shows the high-band VSWR result to be approximately 1.2. From the relation $$VSWR = \frac{1 + |\Gamma|}{1 - |\Gamma|}$$

The reflection coefficient magnitude is found as $$|\Gamma| = 0.09$$

The antenna impedance can then be found, assuming a 50Ω feed network impedance:

$$|\Gamma| = \frac{Z_L - Z_0}{Z_L + Z_0}$$

$$0.09 = \frac{Z_L - 50}{Z_L + 50}$$

$$Z_L \cong 59\Omega$$

A similar calculation for the low-band result shows that the impedance of 75Ω seen at this lower frequency is not as well matched to the feed network impedance, thereby decreasing the efficiency. The mismatch at one of the operating frequencies is a drawback of this design.

Multiresonant designs of this type have an additional problem; because the antenna may receive signals at all natural resonances, additional circuitry may be required in the wireless radio receiver to filter undesired signals.

SUMMARY OF THE INVENTION

According to one aspect of the present invention, there is provided an antenna comprising: a radiating element resonant on at least two frequencies; at least two matching elements respectively corresponding to at least one frequency of the at least two frequencies; and a switching element, that for a selected frequency of the at least two frequencies, is adapted to selectively electrically connect to the radiating element one or more of the matching elements that correspond to the selected frequency.

In some embodiments, the radiating element comprises: at least two radiating sections; and a discontinuity bridging the at least two radiating sections.

In some embodiments, the discontinuity causes a partial reflection at ends of the at least two radiating sections.

In some embodiments, the discontinuity comprises at least one of: a bend; a change in impedance between ends of the radiating sections; a change in materials between ends of the radiating sections; a change in geometry of ends of the radiating sections; and an electrically short gap between ends of the radiating sections.

In some embodiments, the antenna further comprises a radiating feed element electrically connected to the radiating element, wherein: the radiating feed element and the at least two radiating sections form at least two resonators respectively corresponding to at least one of the at least two frequencies; and each one of the at least two matching elements substantially matches an impedance at a feed point of the radiating feed element to a reference source impedance for at least one of the at least two frequencies.

In some embodiments, the at least two frequencies correspond to frequency bands that include at least one of the following: 125-134 kHz; 13.56 MHz; 400-930 MHz; 1.8 GHz; 2.3 GHz; 2.4 GHz; 2.45 GHz; 2.5 GHz; 3.5 GHz; and 5.8 GHz.

In some embodiments, the switching element comprises at least one of: a Microelectromechanical-based (MEMS-based) capacitive switch; a PIN diode-based switch; a transistor-based switch; a MEMS-based contact switch; and a combination thereof.

In some embodiments, each matching element comprises at least one of: a grounded stub; an open stub; a lumped element network; a transformer; and a combination thereof.

In some embodiments, the at least two radiating sections are connected in series with the discontinuity bridging between respective ends of the radiating sections.

In some embodiments, the antenna further comprises a radiating feed element electrically connected to the radiating element, wherein the at least two radiating sections comprise a first radiating section and a second radiating section, and the at least two matching elements comprise a first matching element and a second matching element.

In some embodiments, the first radiating section and the second radiating section form an angle.

In some embodiments, the antenna further comprises a surface at a reference voltage, wherein at least one of the at least two matching elements is electrically connected to the surface.

In some embodiments: the radiating feed element, the first radiating section and the second radiating section form a first quarter wave resonator having a first resonant frequency of the at least two frequencies; the radiating feed element and the first radiating section form a second quarter wave resonator having a second resonant frequency of the at least two frequencies; the first matching element substantially matches an impedance at a feed point of the radiating feed element to a reference source impedance at the first resonant frequency; and the second matching element substantially matches the impedance at the feed point of the radiating feed element to the reference source impedance at the second resonant frequency.

In some embodiments, the antenna further comprises a radiating feed element electrically connected to the radiating element, wherein the at least two radiating sections comprise a first radiating section, a second radiating section and a third radiating section, and the at least two matching elements comprise a first matching element, a second matching element and a third matching element, wherein: the radiating feed element, the first radiating section, the second radiating section and the third radiating section form a first quarter-wave resonator having a first resonant frequency of the at least two frequencies; the radiating feed element, the first radiating section and the second radiating section form a second quarter-wave resonator having a second resonant frequency of the at least two frequencies; the radiating feed element and the first radiating section form a third quarter-wave resonator having a third resonant frequency of the at least two frequencies; the first matching element substantially matches an impedance at a feed point of the radiating feed element to a reference source impedance at the first resonant frequency; the second matching element substantially matches the impedance at the feed point of the radiating feed element to the reference source impedance at the second resonant frequency; and the third matching element substantially matches the impedance at the feed point of the radiating feed element to the reference source impedance at the third resonant frequency.

According to another broad aspect of the present invention, there is provided a steerable beam antenna array comprising a plurality of antennas according to the above aspect of the present invention arranged to form any one of: a linear array; a planar array; and a volume array.

According to still another broad aspect of the present invention, there is provided a method for selectively operating an antenna having a radiating element that is resonant at a plurality of resonant frequencies, comprising: a) selecting at least one resonant frequency from the plurality of resonant frequencies; and b) selectively electrically connecting a matching element corresponding to the at least one selected resonant frequency to the radiating element.

In some embodiments, selectively electrically connecting the matching element corresponding to the at least one selected resonant frequency to the radiating element substantially matches an impedance at a feed point of the radiating element to a reference impedance at the at least one selected resonant frequency.

In some embodiments, selectively electrically connecting the matching element corresponding to the at least one selected resonant frequency to the radiating element comprises controlling a switching element to select the matching element corresponding to the at least one selected resonant frequency from a plurality of matching elements.

In some embodiments, controlling the switching element comprises at least one of: applying at least one voltage to the switching element; applying at least one magnetic field to the switching element; applying thermal energy to the switching element; applying at least one mechanical force to the switching element; and a combination thereof.

In some embodiments, the method further comprises at least one of: transmitting and receiving, wherein: transmitting comprises feeding a signal having at least one of the at least one selected resonant frequency to the feed point of the radiating element from a transceiver having the reference impedance; and receiving comprises receiving a wireless signal having at least one of the at least one selected resonant frequency with the radiating element and feeding the received signal to the transceiver from the feed point of the radiating element.

Other aspects and features of the present invention will become apparent, to those ordinarily skilled in the art, upon review of the following description of the specific embodiments of the invention.

BRIEF DESCRIPTION OF THE DRAWINGS

Embodiments of the invention will now be described in greater detail with reference to the accompanying drawings, in which.

In the drawings, closely related elements have the same reference numeral but different alphabetic suffixes. When the same part is illustrated in multiple figures, the same reference numeral is used to identify it.

DETAILED DESCRIPTION

In the following detailed description of sample embodiments of the present invention, reference is made to the accompanying drawings, which form a part hereof, and in which is shown by way of illustration specific sample embodiments in which the present invention may be practiced. These embodiments are described in sufficient detail to enable those skilled in the art to practice the invention, and it is to be understood that other embodiments may be utilized and that logical, mechanical, electrical, and other changes may be made without departing from the scope of the invention. The following detailed description is, therefore, not to be taken in a limiting sense, and the scope is defined by the appended claims.

Various multi-band antennas and methods for radiating at multiple frequency bands are provided.

An inverted-F antenna 40 in accordance with an embodiment of the present invention will now be described with reference to FIG. 4.

Figure 1:
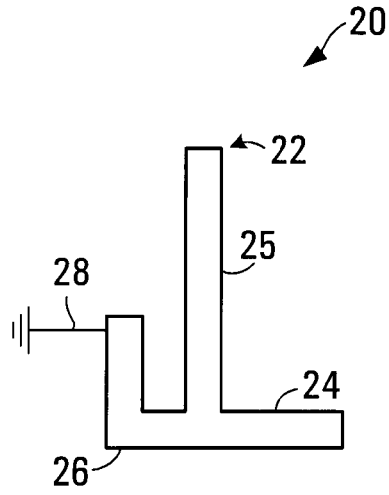
FIG. 1 Prior Art
FIG. 1 is a diagram of a conventional planar inverted-F antenna.
Figure 2:
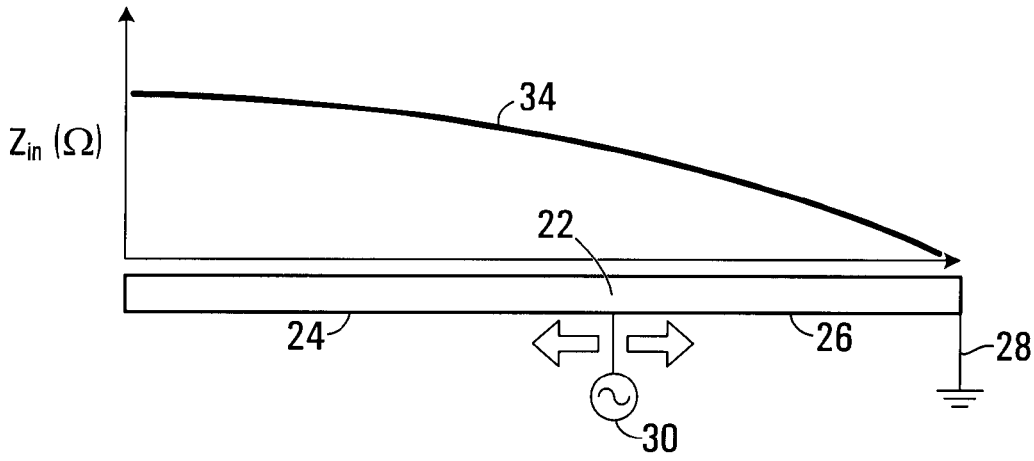
FIG. 2 Prior Art
FIG. 2 is a representation of the impedance distribution on a monopole antenna.
Figure 3:
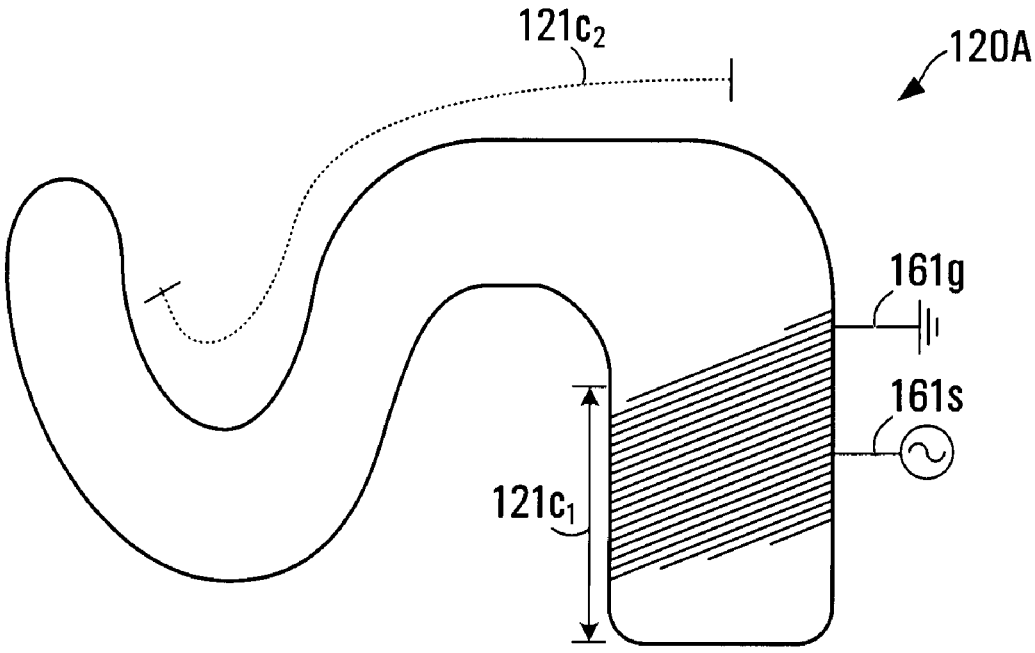
FIG. 3 Prior Art
FIG. 3 is a top view of another conventional planar Inverted-F antenna.
Figure 4:
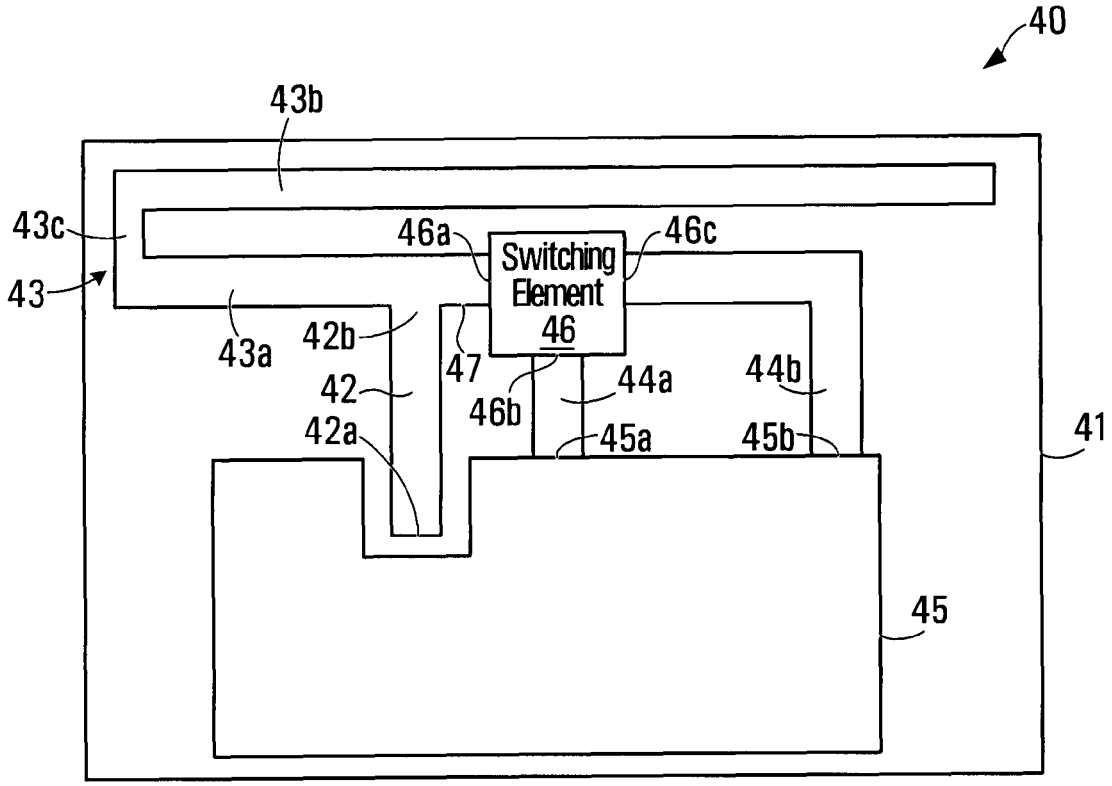
FIG. 4 is a top view of an inverted-F antenna according to an embodiment of the present invention.

In FIG. 4, the inverted-F antenna 40 includes a radiating feed element 42, a radiating element 43, two matching elements 44*a*, 44*b*, a switching element 46 and a surface 45, implemented on a dielectric substrate 41. In some embodiments, the surface 45 is electrically grounded to act as a ground plane to provide grounding points for the matching elements 44*a*, 44*b*. More generally, the surface 45 may be maintained at a reference voltage related to the signal transmitted or received by the antenna 40. For example, in some embodiments, the antenna 40 may be fed with a signal that has a non-zero DC bias, and the surface 45 may be maintained at the non-zero DC bias. In still other embodiments, the surface 45 may not be present. In this case, the matching elements may be connected to a reference voltage externally. In some embodiments, more than one surface may be provided.

In the embodiment shown in FIG. 4, all of the antenna components are located on the top of the dielectric substrate 41. More generally, the antenna components may be located on either side of the dielectric substrate or on an interior layer of a multi-layer dielectric substrate.

The radiating element 43 includes a first section 43*a*, and a second section 43*b*, which are connected by a short conductive section 43*c*. In this embodiment, the second section 43*b* is substantially parallel to the first section 43*a*, and the connecting conductor section 43*c* is perpendicular to both sections 43*a*, 43*b*. The bends introduced by the short section 43*c* act as discontinuities that bridge ends of the radiating sections 43*a* and 43*b* along the length of the radiating element 43.

One end 42*a* of the radiating feed element 42 is connected to a terminal (not shown), while a second end 42*b* of the radiating feed element 42 is connected to the radiating element 43 proximal to one end 47 of the first section 43*a* of the radiating element.

The switching element 46 has three ports 46*a*, 46*b*, 46*c* that are connected to the end 47 of the first section 43*a* of the radiating element 43, the first matching element 44*a* and the second matching element 44*b*, respectively.

The matching elements 44*a*, 44*b* are also connected to the surface 45 at points 45*a*, 45*b*, respectively.

The radiating feed element 42, the sections 43*a*, 43*b*, 43*c* of the radiating element 43 and the matching elements 44*a*, 44*b* may be implemented in metal, such as copper, aluminum, or another suitable radiating material.

In the embodiment shown in FIG. 4, the matching elements are implemented as "shorted stubs", i.e. lengths of conductive microstrip that are grounded at one end. In general, any type of matching element may be used to match the impedance of the antenna to the source impedance at the desired radiation frequency band. Examples of other matching elements that may be used in some embodiments include open stubs, lumped element networks and transformers.

Although generally sized to a quarter-wavelength, the exact dimensions of an Inverted-F Antenna will depend on many other factors, such as the trace and dielectric material, the geometry, and the type of feeding network, among others. For example, in this particular embodiment, for operation at approximately 1.8 GHz and 5.8 GHz, the traces are formed in half-ounce copper on a 20 mil Rogers RO4003C dielectric substrate. The radiating feed element, 42, is 1 mm by 5 mm, radiating section 43*a* is 1 mm by 14 mm, the connecting conductor 43*c* is 0.3 mm by 1 mm, radiating section 43*b* is 0.5 mm by 31 mm. Matching element 44*a*, separated from the radiating feed element 42 by 5 mm, is 1 mm by 3 mm. Matching element 44*b*, separated from the radiating feed element 42 by 9 mm, has a total length of 6 mm. Surface 45 is 18 mm by 10 mm with a 4 mm by 4 mm cutout centered at point 42*a* on the radiating feed element 42. The above dimensions are merely exemplary; the dimensions of the components of the antenna are an implementation specific detail.

During transmission, the antenna 40 is fed at point 42*a* of the radiating feed element 42 from a wireless device through a terminal (not shown). During reception, the antenna 40 feeds a received wireless signal to the wireless device through the terminal (not shown) at point 42*a* of the radiating feed element 42. The discontinuity introduced by the connecting conductor 43*c* between the first radiating section 43*a* and the second radiating section 43*b* results in resonance at two frequency bands.

The matching element 44*a* is designed such that connecting the matching element 44*a* to the radiating element 43 causes the input impedance of the antenna 40 at the point 42*a* of the radiating feed element 42 to be substantially matched to the impedance of the terminal of the wireless device at one of the two frequency bands.

Similarly, the matching element 44*b* is designed such that connecting the matching element 44*b*, rather than the matching element 44*a*, to the radiating element 43 causes the input impedance of the antenna 40 to be substantially matched to the impedance of the terminal of the wireless device at the other one of the two frequency bands.

Accordingly, selecting the radiating frequency of the antenna 40 for transmitting and receiving can be done by selectively connecting the matching element 44*a* or 44*b*, which corresponds to the desired radiating frequency band, to the radiating element 43 through the switching element 46.

Figure 5:
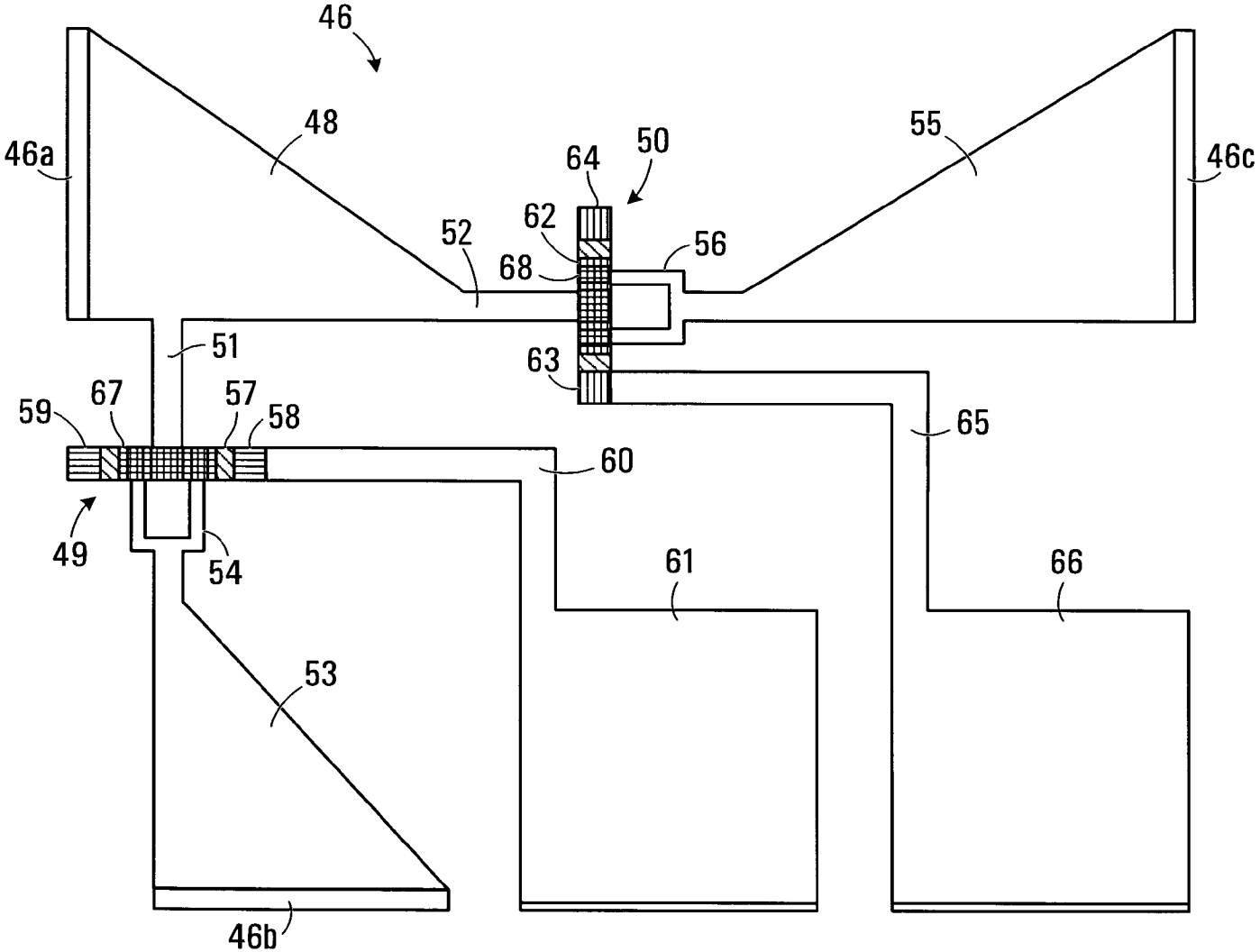
FIG. 5 is a top view of a switching element according to an embodiment of the present invention.

One embodiment of the switching element 46 is shown in FIG. 5. The embodiment shown in FIG. 5 presents a surface-mounted switching element 46 based on MEMS (Microelectromechanical Systems) capacitive switches 49 and 50.

In the switching element 46 shown in FIG. 5, a conductor 48 provides a connection from an end 47 of the radiating element 43 at point 46*a*, to the two MEMS switches 49 and 50 via two conductive traces 51 and 52, respectively. A conductor 53 connects the first matching element 44*a* at point 46*b* to the first MEMS switch 49 via a conductive trace 54. A conductor 55 connects the second matching element 44*b* at point 46*c* to the second MEMS switch 50 via a conductive trace 56. The first MEMS switch 49 has a top conductive layer 57 that is anchored by metal posts 58 and 59. Post 58 is electrically connected via a conductor 60 to a feeding pad 61. The top conductive layer 62 of the second MEMS switch 50 is anchored by metal posts 63 and 64. Post 63 is electrically connected via a conductor 65 to a feeding pad 66.

In the embodiment shown in FIG. 5, all conductive surfaces of the switching element 46 are constructed in copper, aluminum, or another suitable conductor on a dielectric substrate.

Actuating voltages for MEMS switches 49 and 50 are provided through terminals (not shown) connected to feeding pads 61 and 66, respectively.

Figure 6:
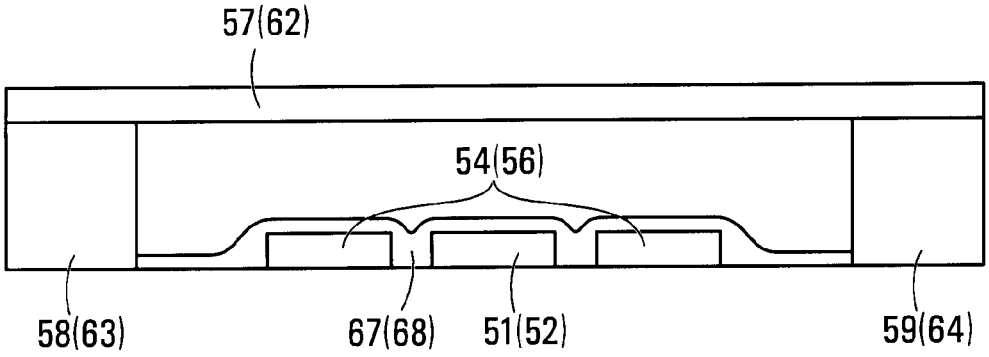
FIG. 6 is a profile view of a switching element according to an embodiment of the present invention.

A profile view of the layers of the switches 49, 50 is shown in FIG. 6. Conductive traces 51 and 54 form the bottom conductive surface of the first capacitive switch 49, and are covered by a dielectric layer 67, such as silicon nitride, quartz, or some other suitable dielectric material. An air gap separates this dielectric layer 67 from the top metal layer 57. Similarly, conductive traces 52 and 56 form the bottom conductive surface of the second capacitive switch 50. The conductive traces 52 and 56 are covered by a dielectric layer 68, and are separated from the top metal layer 62 by an air gap. The construction of the MEMS-based switching element 46 can be accomplished in a variety of processes, such as etching, chemical vapour deposition, physical vapour deposition, micromachining and other conventional integrated circuit fabrication processes.

The dimensions of the pads 61 and 66 and conductive traces 51, 52, 54, 56, 60 and 65 are not as critical as the dimensions of the switches 49 and 50 themselves. Each different antenna design may call for a different capacitance value from the MEMS switches 49 and 50 to ensure proper electrical connection between the radiating element 43 and the matching elements 44*a* and 44*b* while the switches are closed and good isolation between the radiating and matching elements while the switches are open. Also, the capacitance of the switches may be tuned to minimize the reactance presented to the transmitting/receiving terminal of the wireless device by the radiating element 43 and the radiating feed element 42 at the feed point 42*a*. In the embodiment shown in FIG. 5, the upper conductive layer 57(62) is 150 μm wide by 350 μm across, and the lower conductors 54(56) and 51(52) are 100 μm and 50 μm across for the middle conductor 51(52) and the two surrounding conductors 54(56), respectively. The lower conductors 54(56) and 51(52) are approximately central to the upper conductor 57(62). There is a space of 25 μm between each of the lower conductors 54(56) and 51(52).

It should be appreciated that the MEMS-based capacitive switching element 46 shown in FIG. 5 is provided as one very specific example of a switching element that may be used in accordance with an embodiment of the present invention. More generally, any switching element capable of selectively electrically connecting matching elements, such as the matching elements 44*a* and 44*b*, to a radiating element, such as the radiating element 43, may be used. For example, in some embodiments, the switching element 46 may be implemented using PIN diodes, MEMS contact switches, or transistors, such as MOSFETs, MESFETs, HBTs, BJTs, or the like, as switches, as mentioned in Chapter 1 of G. M. Rebeiz, "*RF MEMS: Theory, Design and Technology*"—New Jersey: John Wiley & Sons, 2003, which is hereby incorporated by reference in its entirety.

Operation of the antenna 40 in accordance with an embodiment of the present invention will now be described with reference to FIGS. 4, 5, 6, 8A and 8B.

In operation, the antenna 40 operates in two frequency bands: a high band and a low band. In some embodiments, the radiating feed element 42 and the radiating sections 43*a*, 43*b*, and 43*c* form a quarter-wave resonator at the low band and the radiating feed element 42 and the radiating section 43*a* form a quarter-wave resonator at the high band. By controlling the switching element 46, for example, by applying the appropriate actuating voltages to the terminals (not shown) connected to the feed pads 61 and 66 of the switching element 46 shown in FIG. 5, matching element 44*a* or 44*b* can be electrically connected to radiating element 43 at the end 47 of the first radiating section 43*a* to allow the antenna to operate in the high or low band, respectively.

Applying the appropriate actuating voltage to the feed pad 66 causes the second switch 50 to electrically connect matching stub 44*b* to radiating section 43*a*. When connected to the radiating element 43, matching element 44*b* produces an impedance suitable for low band operation. This arrangement allows the radiating feed element 42 and the radiating sections 43*a*, 43*b*, and 43*c* to resonate and to present an impedance that is substantially matched at the low band frequency to the impedance of a transmitter/receiver feeding network (not shown) seen at point 42*a* of the radiating feed element 42.

Applying the appropriate actuating voltage to the feed pad 61 causes the first switch 49 to electrically connect matching stub 44*a* to radiating section 43*a*. When connected to the radiating element 43, the matching element 44*a* produces an impedance suitable for high-band operation. This arrangement allows the radiating feed element 42 and the radiating section 43*a* to resonate and to present an impedance that is substantially matched at the high band frequency to the impedance of a transmitter/receiver feeding network seen at point 42*a* of the radiating feed element 42.

In some embodiments, the antenna 40 may have more than one natural resonant frequency for the electrical lengths established by the radiating feed element 42 and the radiating sections 43*a*, 43*b*, 43*c* of the radiating element 43. For example, the electrical length of the first radiating section 43*a* in combination with the radiating feed element 42 may have two or more natural resonances. A matching element may substantially match the impedance of the feed point 42*a* to a reference impedance for one or more of the natural resonances associated with a particular electrical length.

The arrangement shown in FIGS. 4 and 5 should not be construed to limit the scope of the invention, but rather exemplifies one possible embodiment. Matching elements 4*a* or 4*b* could be connected at low and high bands respectively, or vice-versa, and at any number of frequencies.

In some embodiments, electrical connections between the matching elements 44*a* and 44*b* and the radiating element 43 as described earlier may be accomplished through the use of MEMS capacitive switches, such as those 49 and 50 illustrated in FIGS. 5 and 6. In these embodiments, an actuation voltage is applied at the feeding pad 61, creating an electric field between the top conductive layer 57 of the first switch 49 and the lower conductive surfaces 51 and 54. The electric field applies a force to the top conductive layer 57 that causes a downward deflection of the top conductive layer. When a sufficiently large voltage is applied, the top conductive layer 57 buckles; thus the top conductive layer is separated from the bottom conductive surfaces 51 and 54 by only the thin dielectric layer 67. The proximity of the top 57 and bottom 51 and 54 conductive surfaces capacitively couples traces 51 and 54 together, thereby electrically connecting the matching stub 44*a* to the radiating element 43.

Similarly, an actuation voltage applied at the feeding pad 66 creates an electric field between top conductive layer 62 and the lower conductive surfaces 52 and 56 of the second MEMS switch 50. The electric field applies a force to the top conductive layer 62 that causes a downward deflection of the conductive layer. When a sufficiently large voltage is applied, the top conductive layer 62 buckles; thus the top conductive layer 62 is separated from the bottom conductive surfaces 52 and 56 by only the thin dielectric layer 68. The proximity of the top 62 and bottom 52 and 56 conductive surfaces capacitively couples traces 52 and 56 together, thereby electrically connecting the matching stub 44*b* to the radiating element 43.

Figure 8A:
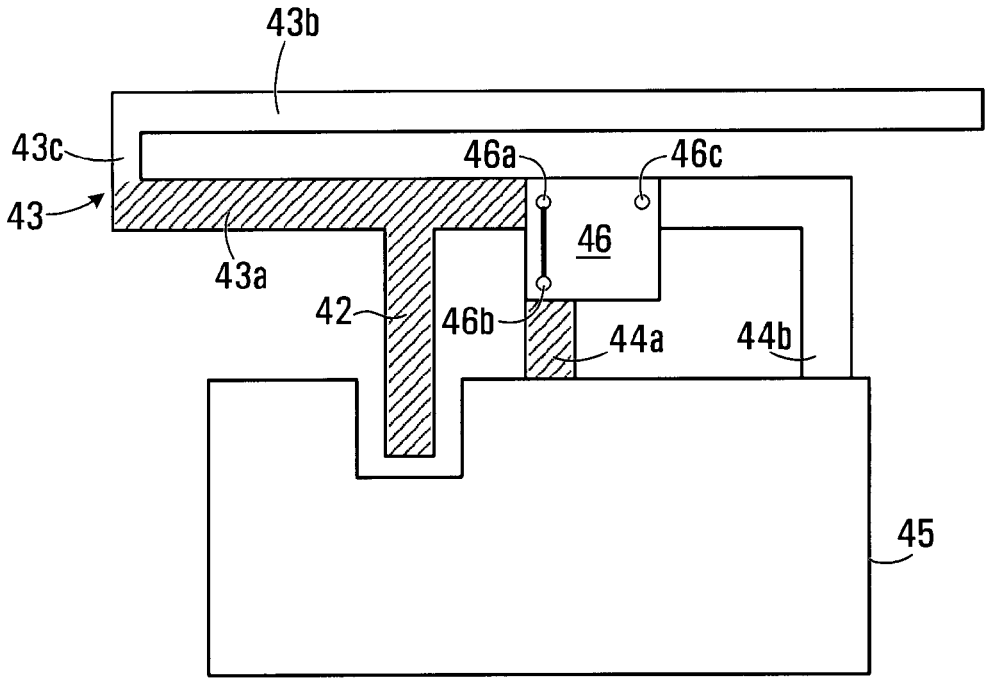
FIG. 8A is a current density plot of the antenna shown in FIG. 4 at 5.8 GHz.
Figure 8B:
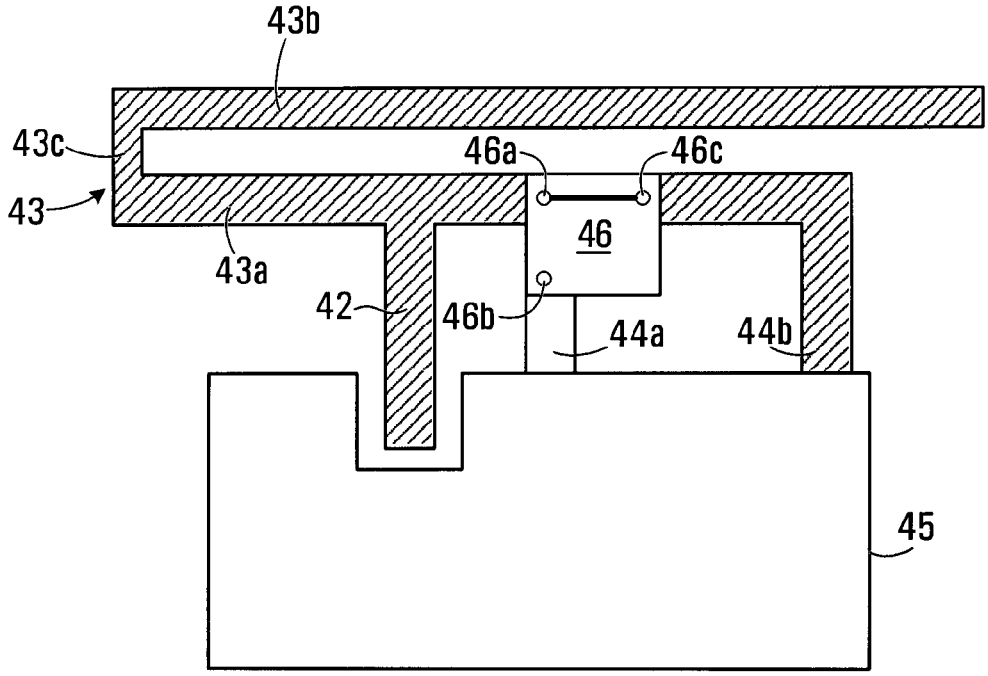
FIG. 8B is a current density plot of the antenna shown in FIG. 4 at 1.8 GHz.

FIGS. 8A and 8B illustrate the current densities in the radiating feed element 42, the radiating element 43 and the matching elements 44*a* and 44*b* of the embodiment shown in FIG. 4 for operation in the high frequency band and the low frequency band, respectively.

In FIG. 8A, the switching element 46 has been switched to connect the first matching element 44*a* to the end of the first section 43*a* of the radiating element 43. If the switching element 46 is implemented using the MEMS-based capacitive switching element 46 shown in FIG. 5, switching the switching element in this manner may be done by applying the appropriate actuation voltage to the feed pad 61 to actuate the first MEMS switch 49. With the radiating element 43 electrically connected to the first matching element 44*a*, the input impedance of the antenna is matched to the source impedance (not shown) at the high band frequency. This arrangement allows the first radiating section 43*a* to resonate and therefore the signal current is substantially limited to the radiating feed element 42, the first radiating section 43*a* and the first matching element 44*a*.

In FIG. 8B, the switching element 46 has been switched to connect the second matching element 44*b* to the end of the first section 43*a* of the radiating element 43. If the switching element 46 is implemented using the MEMS-based capacitive switching element 46 shown in FIG. 5, switching the switching element in this manner may be done by applying the appropriate actuation voltage to the feed pad 66 to actuate the second MEMS switch 50. With the radiating element 43 electrically connected to the second matching element 44*b*, the input impedance of the antenna is matched to the source impedance (not shown) at the low band frequency. This arrangement allows the signal current to flow across, the radiating feed element 42, all of the radiating sections 43*a*, 43*b* and 43*c* and the second matching element 44*b*.

Figure 7:
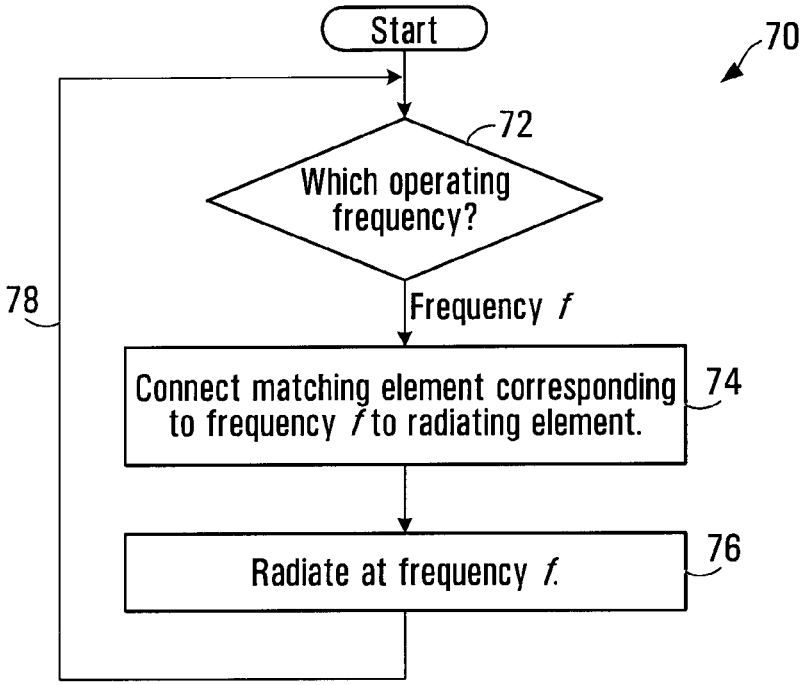
FIG. 7 is a flowchart describing a method of radiation in accordance with an embodiment of the present invention.

An example of a method 70 of radiation on multiple frequency bands in accordance with an embodiment of the present invention is illustrated in FIG. 7 as a flowchart. The method 70 may, for example, be used in conjunction with the antenna 40 shown in FIG. 4, or with any of the embodiments described below with reference to FIGS. 9 to 12. More generally, the method 70 may be used with any antenna that includes a radiating element that is resonant at a plurality of resonant frequencies, and a plurality of matching elements each corresponding to at least one of the frequency bands of operation.

The method begins at step 72, in which an operating frequency f is selected. The antenna may be operable to radiate at one or more of a plurality of frequency bands, and the frequency f corresponds to one of these frequency bands.

In step 74, a matching element corresponding to the selected frequency f is electrically connected to the radiating element to substantially match the impedance of the antenna at a feed point to a particular transmitter/receiver impedance at the selected frequency f.

In some embodiments, the impedance of the antenna is matched to 50Ω.

In some embodiments, more than one matching element may correspond to one or more selected frequency bands.

In some embodiments, electrically connecting the radiating element to the matching element corresponding to the selected frequency f is done by switching a switching element to select the matching element corresponding to the selected frequency f.

In some embodiments, switching the switching element includes applying an actuating voltage to a switch, such as a MEMS-based capacitive switch, applying a magnetic field, applying thermal energy, and/or applying a mechanical force.

In step 76, a signal is applied to the antenna at the selected frequency f and the antenna radiates at that frequency. For transmission, a signal at the selected frequency f is applied to the antenna at the feed point, and because the impedance of the antenna at the feed point is substantially matched to the impedance of a transceiver/transmitter at the selected frequency f, the signal is substantially passed to the antenna causing the antenna to resonate and radiate at that frequency and transmits the signal. For reception, one or more wireless signals, including a wireless signal at the selected frequency f, is received at the antenna, i.e. applied to the antenna, and the antenna resonates at that frequency and because the impedance of the antenna is substantially matched to the impedance of a wireless transceiver/receiver at the selected frequency f, the received signal is substantially passed to the wireless transceiver/receiver.

In some embodiments, the method 70 returns to step 72 through the return path 78, so that a different radiating frequency f can be selected.

In some embodiments, a source applies/receives a feed signal to/from the antenna through a radiating feed element connected to the radiating element.

In some embodiments, the radiating element includes two radiating sections and a discontinuity bridging the two radiating sections, and the antenna includes two matching elements corresponding to two frequency bands of operation.

In some embodiments, the radiating element includes three radiating sections bridged by a first discontinuity between the first radiating section and the second radiating section and a second discontinuity between the second radiating section and the third radiating section, and the antenna includes three matching element corresponding to three frequency bands of operation.

In some embodiments, an antenna having a radiating element with N radiating sections and N−1 discontinuities respectively bridging the N radiating sections, may have N+1 or more frequency bands of operation if an electrical length established by the radiating sections, or a subset thereof, has more than one natural resonance. In such embodiments, an individual matching element may substantially match the impedance of the antenna at more than one of the natural resonances for an electrical length resulting from a particular combination of radiating sections, and therefore the antenna may include matching elements that correspond to more than one frequency band of operation.

The arrangement described above with reference to FIGS. 4 to 6 and 8 should in no way be considered to limit the scope of the invention; many other configurations are possible. For instance, the connecting conductor 43*c* may not be included in some embodiments since the multiple resonances can be obtained from many types of discontinuities.

In some embodiments, the double bend in the radiating element 43 caused by the connecting conductor 43*c* may be undesirable, since the length of the connecting conductor 43*c* can give rise to three resonant frequencies: one that results from the combined electrical length of the radiating feed element 42, the first radiating section 43*a* and the connecting conductor 43*c*, another that results from the combined electrical length of the radiating feed element 42 and the first radiating section 43*a*, and a third that results from the combined electrical length of the radiating feed element 42 and all of the radiating sections 43*a*, 43*b*, and 43*c*.

Figure 9:
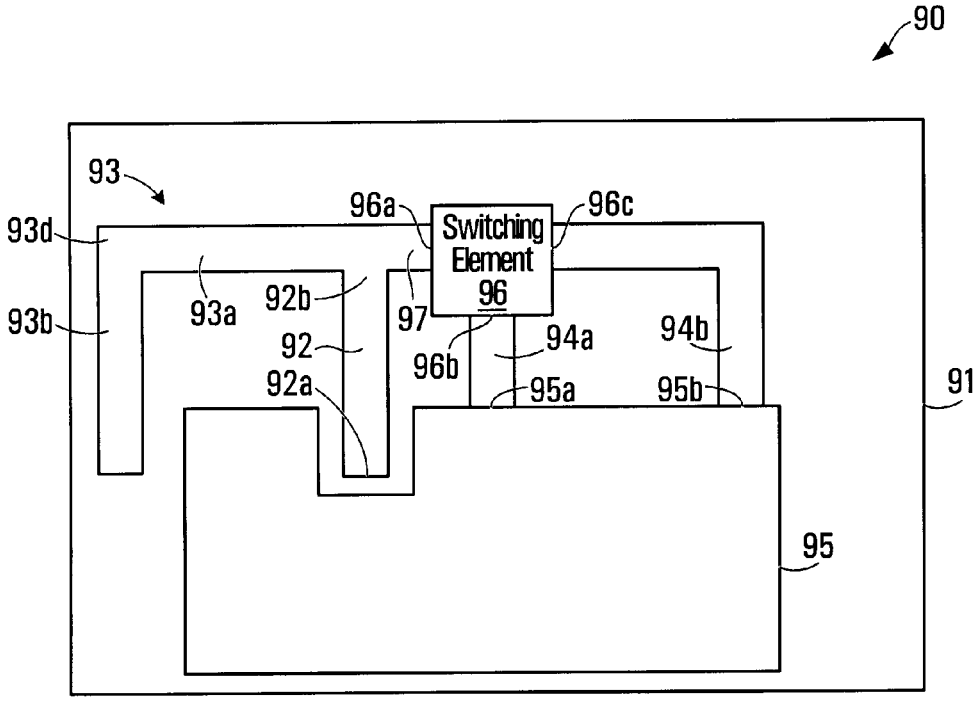
FIG. 9 is a top view of an inverted-F antenna according to another embodiment of the present invention.

FIG. 9 illustrates an antenna 90 in accordance with another embodiment of the present invention, in which a radiating element 93 includes a first radiating section 93*a* and a second radiating section 93*b* with a discontinuity bridging the first radiating section 93*a* and the second radiating section 93*b*. In the embodiment shown in FIG. 9, the second radiating section 93*b* is disposed substantially perpendicular to the first radiating section 93*a*, and the discontinuity occurs at a bend 93*d*.

Similar to the embodiment shown in FIG. 4, in the embodiment shown in FIG. 9 the first radiating section of the radiating element 93 is connected to one end 92*b* of a radiating feed element 92. A second end 92*a* of the radiating feed element is generally connected to a source terminal (not shown).

In the embodiment shown in FIG. 9, a switching element 96 has a first port 96*a* that is connected to the end 97 of the first radiating section 93*a* of the radiating element 93, a second port 96*b* that is connected to a first matching element 94*a*, and a third port 96*c* that is connected to a second matching element 94*b*.

The first matching element 94*a* and the second matching element 94*b* are connected to a surface 95 at points 95*a* and 95*b*, respectively. In some embodiments, the surface 95 is electrically grounded.

In the embodiment shown in FIG. 9, all of the components of the antenna 90 are implemented on a dielectric substrate 91.

While the matching elements 94*a* and 94*b* are shown as shorted stubs in FIG. 9, in some embodiments, they may be implemented using open stubs, lumped element networks, transformers, or combinations thereof.

The switching element 96 may, for example, be implemented using the MEMS-based capacitive switching element shown in FIG. 5. More generally, the switching element 96 may be implemented by any element capable of selectively connecting a matching element to the radiating element 43.

The antenna structure 90 operates as previously described with reference to the antenna structure 40 shown in FIG. 4, where the radiating feed element 92 and the radiating sections 93*a* and 93*b* of the radiating element 93 form a quarter-wave resonator at a lower band and the radiating feed element 92 and the first radiating section 93*a* form a quarter-wave resonator at a higher band, and the matching elements 94*a* and 94*b* are selectively connected to the radiating element 93 to provide matching at either the high band or the low band, respectively.

Figure 10:
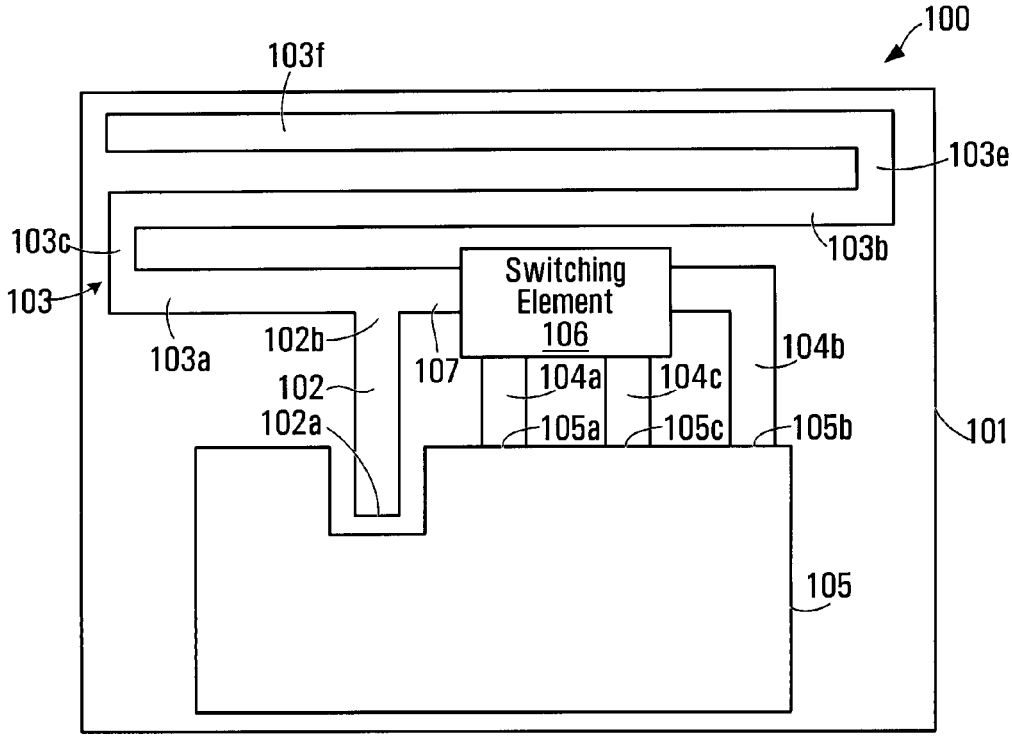
FIG. 10 is a top view of an inverted-F antenna according to still a further embodiment of the present invention.

Embodiments of the present invention are not limited to only two bands of operation. Other embodiments producing multiple frequencies of operation are also possible. One example of a tri-band antenna structure 100 is shown in FIG. 10. The tri-band antenna structure 100 includes a radiating element 103 that has a first radiating section 103*a* that is connected to a second radiating section 103*b* through a conductor connection 103*c* that establishes a discontinuity that bridges the first radiating section 103*a* and the second radiating section 103*b*.

The first radiating section 103*a* is substantially parallel to the second radiating section 103*b* and the conductor connection 103*c* is substantially perpendicular to the first radiating section 103*a* and the second radiating section 103*b* to connect them.

A third radiating section 103*f* is connected to the second radiating section 103*b* through a second conductor connection 103*e* that establishes a discontinuity that bridges the second radiating section 103*b* and the third radiating section 103*f*.

The third radiating section 103*f* is arranged substantially parallel to the second radiating section 103*b* and the second conductor connection 103*e* is arranged substantially perpendicular to the second radiating section 103*b* and the third radiating section 103*f* to connect them.

In the embodiment shown in FIG. 10, the antenna structure 100 is implemented on a dielectric substrate 101 and includes a four-port switching element 106 that is connected to the end 107 of the first radiating section 103*a* of the radiating element 103, a first matching element 104*a*, a second matching element 104*b* and a third matching element 104*c*. The matching elements 104*a*, 104*b* and 104*c* are connected to a surface 105 at points 105*a*, 105*b* and 105*c*, respectively. Similar to the embodiments shown in FIGS. 4 and 9, the first radiating section 103*a* of the radiating element 103 is connected to one end 102*b* of a radiating feed element 102, while a second end 102*a* of the radiating feed element is typically connected to a source terminal (not shown).

In operation, the radiating feed element 102 and the radiating sections 103*a*, 103*b*, 103*c*, 103*e*, and 103*f* form a quarter-wave resonator at the lowest design band, the radiating feed element 102 and the radiating sections 103*a*, 103*b*, and 103*c* form a quarter-wave resonator at the middle design band, and the radiating feed element 102 and the radiating section 103*a* form a quarter-wave resonator at the highest design band. The operation and composition of the antenna in this arrangement is similar to that described above, except that three matching elements, 104*a*, 104*b*, and 104*c* are used. By controlling the switching element 106, any one of matching elements 104*a*, 104*b*, or 104*c* can be electrically connected to radiating section 103*a* to allow the antenna 100 to operate in one of the three bands.

Figure 12:
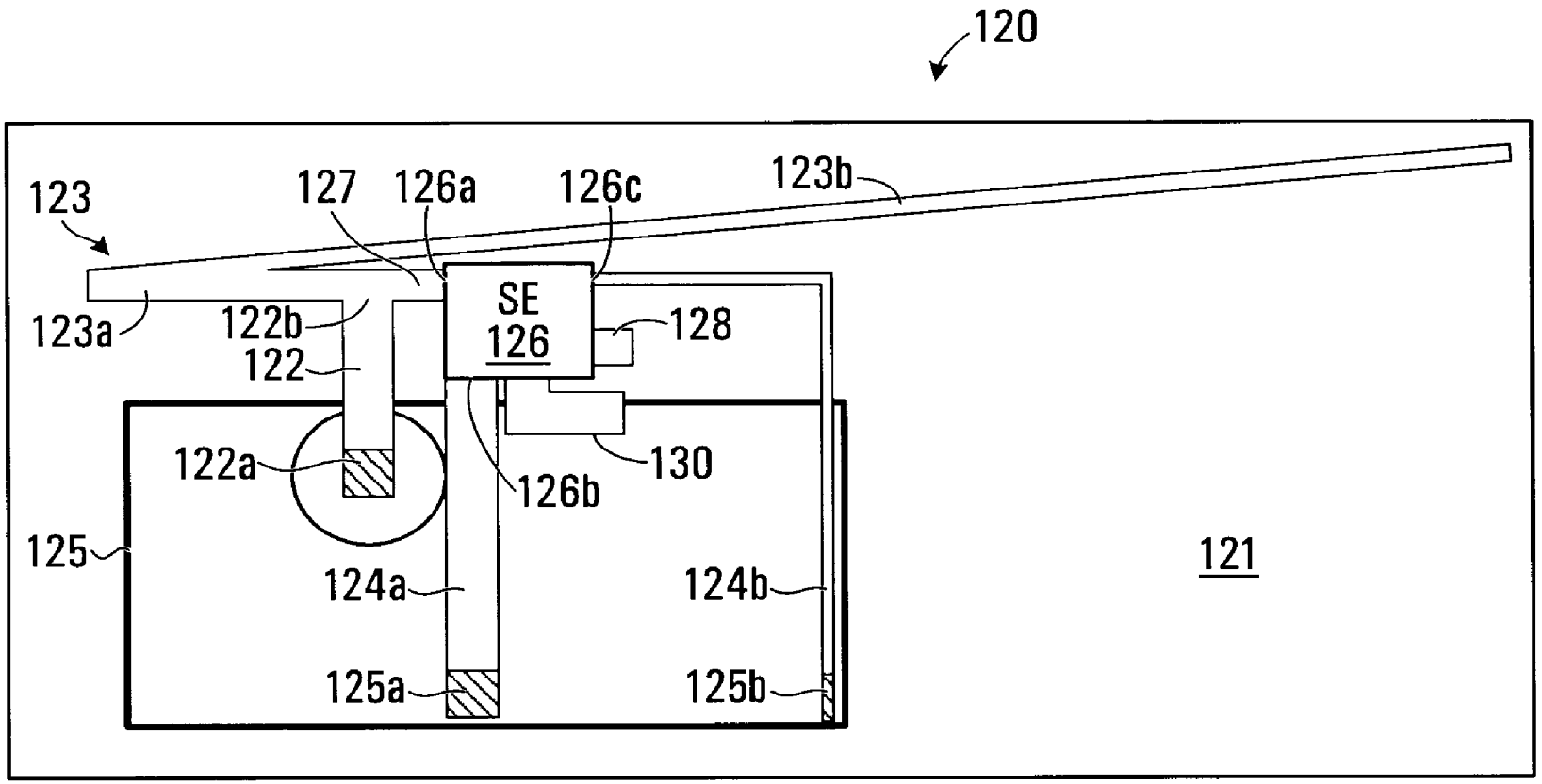
FIG. 12 is a top view of an inverted-F antenna according to another embodiment of the present invention.

Another antenna structure 120 in accordance with an embodiment of the present invention is shown in FIG. 12. In FIG. 12, the antenna structure 120 includes a radiating element 123 that has a first radiating section 123*a* and a second radiating section 123*b*. The antenna structure 120 shown in FIG. 12 is similar to the antenna structure 90 shown in FIG. 9, except that the second radiating section 123*b* forms an angle with respect to the first radiating section 123*a*.

Similar to the embodiment shown in FIG. 9, one end 127 of the first radiating section 123*a* is connected to a first port 126*a* of a switching element 126 in the embodiment shown in FIG. 12. The switching element 126 has a second port 126*b* that is connected to a first matching element 124*a* and a third port 126*c* that is connected to a second matching element 124*b*.

In some embodiments, the switching element 126 is implemented by a MEMS-based capacitive switching element, such as the switching element 46 shown in FIG. 5. In these embodiments, the switching element 126 may also have a first control pad 130 and a second control pad 128 for applying actuating voltages to actuate a first MEMS-based capacitive switch and a second MEMS-based capacitive switch to select between the first matching element 124*a* and the second matching element 124*b*.

The first matching element 124*a* and the second matching element 124*b* are connected to a surface 125 at points 125*a* and 125*b*, respectively. A radiating feed element 122 is connected at one end 122*b* to the first radiating section 123*a* of the radiating element 123 and a second end 122*a* of the radiating feed element is typically connected to a source terminal (not shown).

In the embodiment shown in FIG. 12, the surface 125 is located on one side of a dielectric substrate 121 and all of the other components of the antenna structure 120 are located on the opposite side of the dielectric substrate, which means that the connection 125*a* and 125*b* between the matching components 124*a* and 124*b* and the surface occur through vias in the dielectric substrate. The feed point 122*a* and the control pads 128 and 130 could also be located on the other side of the dielectric substrate 121 and the feed signal and control voltages applied at the feed point and the control pads could be provided through vias to the radiating feed element 122 and the switching element 126, respectively.

In operation, the antenna structure 120 operates as previously described with reference to the antenna structures 40 and 90 shown in FIGS. 4 and 9, respectively, where the radiating sections 123*a* and 123*b* of the radiating element 123 form a quarter-wave resonator at a lower band and the first radiating section 123*a* alone forms a quarter-wave resonator at a higher band, and the matching elements 124*a* and 124*b* are selectively connected to the radiating element 123 to provide matching at either the high band or the low band, respectively.

Experimental results for the embodiment of the antenna 120 of FIG. 12 utilizing the switching element 46 illustrated in FIG. 5 have indicated a low-band VSWR of 1.11, or approximately 45Ω for a 50Ω reference impedance, and a high-band VSWR of 1.02, or approximately 51Ω for a 50Ω reference impedance. With other experimental conditions, similar or possibly different results may be achieved. While the embodiment shown in FIG. 12 is operable on two frequency bands, in some embodiments, one or more additional radiating sections are connected in series to the end of the second radiating section 123*b* so that the radiating sections form a zig-zag pattern. The additional radiating sections form additional quarter-wave resonators with the first radiating section 123*a* and the second radiating section 123*b* so that the antenna can radiate at three or more frequency bands. An additional matching element may be added for each additional radiating section.

As stated on page 719 of Garg et al., "*Microstrip Antenna Design Handbook*" Artech House 2000, " . . . characteristics such as high gain, beam scanning, or steering capability are possible only when discrete radiators are combined to form arrays. The elements of the array may be spatially distributed to form a linear, planar, or volume array."

Figure 11:
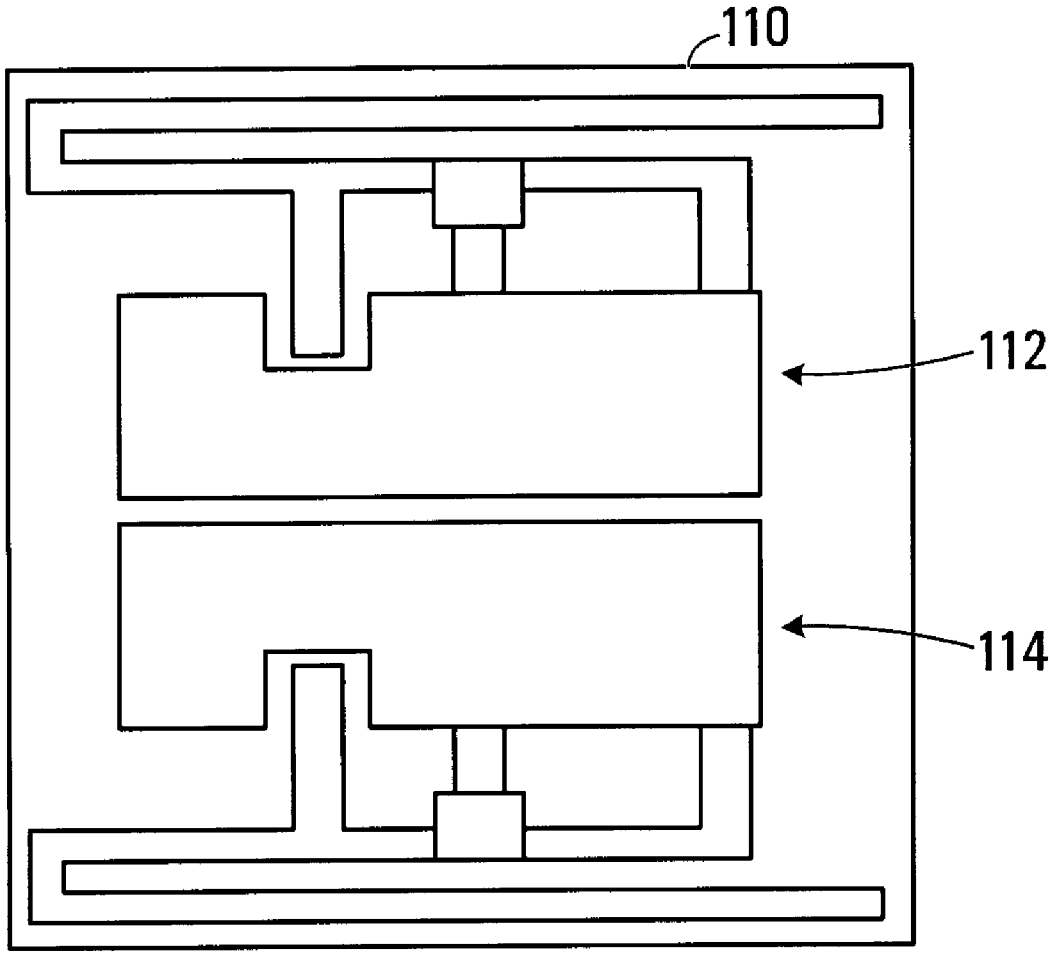
FIG. 11 is a top view of a linear array of inverted-F antennas according to another embodiment of the present invention.

An example of an embodiment of the present invention that includes two antennas arranged to form a linear array 110 will now be described with reference to FIG. 11. In the embodiment shown in FIG. 11, two instances 112 and 114 of the antenna shown in FIG. 4 have been arranged to form the linear array 110. This array configuration is suitable for multi-band beam steerable smart antennas, and, with dimensions of, for example, 40 mm by 35 mm, is still small enough to fit inside a portable radio device. In general, an array of any size could be implemented using antenna elements in accordance with embodiments of the present invention. Dimensions of the individual array elements and of the overall array are implementation specific details.

The embodiments shown in FIGS. 4, 8A, 8B, 9, 10, 11 and 12 utilize bends and/or a changes in geometry along the length of a radiating element to establish radiating sections and a discontinuity between the radiating sections. In some embodiments, a discontinuity is established between radiating sections of a radiating element by a bend, a change in impedance between ends of the radiating sections, a change in geometry of ends of the radiating sections, a change in materials between the ends of the radiating sections, an electrically short gap between ends of the radiating sections, or combinations thereof. More generally, any structure that establishes an electrical discontinuity and bridges radiating sections may be used.

The term bridging is used above to describe an electrical connection between radiating elements that is established by a discontinuity. For example, the bend 93*d* at the overlapping ends of the first radiating section 93*a* and the second radiating section 93*b* in the embodiment shown in FIG. 9, establishes a discontinuity and an electrical connection between the first radiating section 93*a* and the second radiating section 93*b*. Therefore, the discontinuity established by the bend 93*d* is referred to as bridging the first radiating section 93*a* and the second radiating section 93*b*. In some embodiments, a discontinuity may not be a physical connection between the radiating sections. For example, in some embodiments, a gap with a short electrical length between ends of the radiating sections may be used to establish a discontinuity and an electrical connection between the radiating sections, thereby bridging the radiating sections. An electrically short gap can act like a capacitive electrical coupling between the radiating elements, thereby electrically connecting the radiating sections.

While the foregoing embodiments include radiating elements that have at least two radiating sections and a discontinuity bridging the at least two radiating sections, embodiments of the present invention are not limited to antennas of this type, and more generally may include any antenna with a radiating element that can resonant and radiate one at least two frequency bands.

The foregoing description includes many detailed and specific embodiments of the present invention that are provided by way of example only, and should not be construed as limiting the scope of the present invention. Alterations, modifications and variations may be effected to the particular embodiments by those of skill in the art without departing from the scope of the invention, which is defined solely by the claims appended hereto.

The invention claimed is:

1. An antenna comprising:

a radiating element resonant on at least two frequencies, wherein the radiating element comprises:

at least two radiating sections; and a discontinuity bridging the at least two radiating sections, wherein the discontinuity causes at least a partial reflection at ends of the at least two radiating sections, the at least two radiating sections and the discontinuity being configured such that the at least partial reflection at the ends of the at least two radiating sections causes the radiating element to be resonant on the at least two frequencies;

at least two matching elements respectively corresponding to at least one frequency of the at least two frequencies;

a switching element that, for a selected frequency of the at least two frequencies, is adapted to selectively electrically connect, to the radiating element, one or more of the matching elements that correspond to the selected frequency; and a radiating feed element electrically connected to the radiating element, wherein the at least two radiating sections comprise a first radiating section and a second radiating section, and the at least two matching elements comprise a first matching element and a second matching element, wherein:

a combined length of the radiating feed element, the first radiating section and the second radiating section forming a first quarter wave resonator having a first resonant frequency of the at least two frequencies;

a combined length of the radiating feed element and the first radiating section forming a second quarter wave resonator having a second resonant frequency of the at least two frequencies;

the first matching element substantially matches an impedance at a feed point of the radiating feed element to a reference source impedance at the first resonant frequency; and the second matching element substantially matches the impedance at the feed point of the radiating feed element to the reference source impedance at the second resonant frequency.

2. The antenna of claim 1, wherein the discontinuity comprises at least one of: a bend; a change in impedance between ends of the radiating sections; a change in materials between ends of the radiating sections; a change in geometry of ends of the radiating sections; and an electrically short gap between ends of the radiating sections.

3. The antenna of claim 1, wherein the at least two frequencies correspond to frequency bands that include at least one of the following: 125-134 kHz; 13.56 MHz; 400-930 MHz; 1.8 GHz; 2.3 GHz; 2.4 GHz; 2.45 GHz; 2.5 GHz; 3.5 GHz; and 5.8 GHz.

4. The antenna of claim 1, wherein the switching element comprises at least one of: a Microelectromechanical-based (MEMS-based) capacitive switch; a PIN diode-based switch; a transistor-based switch; a MEMS-based contact switch; and a combination thereof.

5. The antenna of claim 1, wherein each matching element comprises at least one of: a grounded stub; an open stub; a lumped element network; a transformer; and a combination thereof.

6. The antenna of claim 1, wherein the at least two radiating sections are connected in series with the discontinuity bridging between respective ends of the radiating sections.

7. The antenna of claim 1, wherein the first radiating section and the second radiating section form an angle.

8. The antenna of claim 1, further comprising a surface at a reference voltage, wherein at least one of the at least two matching elements is electrically connected to the surface.

9. The antenna of claim 1, wherein the at least two radiating sections further comprise a third radiating section, and the at least two matching elements further comprise a third matching element, wherein:

the radiating feed element, the first radiating section, the second radiating section and the third radiating section form a third quarter-wave resonator having a third resonant frequency of the at least two frequencies; and the third matching element substantially matches the impedance at the feed point of the radiating feed element to the reference source impedance at the third resonant frequency.

10. An antenna array comprising a plurality of antennas according to claim 1 arranged to form any one of: a linear array; a planar array; and a volume array.

11. A method for selectively operating an antenna according to claim 1 having a radiating element that has at least two radiating sections, a discontinuity bridging the at least two radiating sections, and is resonant at a plurality of resonant frequencies, the method comprising:

a) selecting at least one resonant frequency from the plurality of resonant frequencies; and b) selectively electrically connecting a matching element corresponding to the at least one selected resonant frequency to the radiating element.

12. The method of claim 11, wherein selecting at least one resonant frequency from the plurality of resonant frequencies comprises:

selecting at least a subset of the at least two radiating sections that correspond to the at least one resonant frequency.

13. The method of claim 11, wherein selectively electrically connecting the matching element corresponding to the at least one selected resonant frequency to the radiating element substantially matches an impedance at a feed point of the radiating element to a reference impedance at the at least one selected resonant frequency.

14. The method of claim 11, wherein selectively electrically connecting the matching element corresponding to the at least one selected resonant frequency to the radiating element comprises controlling a switching element to select the matching element corresponding to the at least one selected resonant frequency from a plurality of matching elements.

15. The method of claim 14, wherein controlling the switching element comprises at least one of: applying at least one voltage to the switching element; applying at least one magnetic field to the switching element; applying thermal energy to the switching element; applying at least one mechanical force to the switching element; and a combination thereof.

16. The method of claim 13, further comprising at least one of: transmitting and receiving, wherein:

transmitting comprises feeding a signal having at least one of the at least one selected resonant frequency to the feed point of the radiating element from a transceiver having the reference impedance; and receiving comprises receiving a wireless signal having at least one of the at least one selected resonant frequency with the radiating element and feeding the received signal to the transceiver from the feed point of the radiating element.

17. The antenna of claim 1, wherein the switching element is configured to selectively electrically connect the one or more of the matching elements to the radiating element at a point proximal to where the radiating feed element is electrically connected to the radiating element.

* * * * *